US005306439A

United States Patent [19]

Lockhart

[11] Patent Number: 5,306,439

[45] Date of Patent: Apr. 26, 1994

[54] JEWELRY CLEANER FORMULATION

[76] Inventor: Ronald R. Lockhart, P.O. Box 331, Downingtown, Pa. 19335

[21] Appl. No.: 21,979

[22] Filed: Feb. 24, 1993

[51] Int. Cl.[5] ..... C11D 17/00; C11D 1/37; C11D 3/08; C11D 7/12

[52] U.S. Cl. ..... 252/174; 252/90; 252/157; 252/160; 252/174.14; 252/174.19; 252/174.25; 252/550; 252/558

[58] Field of Search ..... 252/90, 157, 160, 174, 252/174.14, 174.19, 174.25, 550, 558

[56] References Cited

U.S. PATENT DOCUMENTS

| | | | |
|---|---|---|---|
| 3,367,876 | 2/1968 | Keast et al. | 252/550 |
| 3,607,759 | 9/1971 | Barth | 252/95 |
| 3,639,568 | 2/1972 | Schmitt | 252/167 |
| 4,180,467 | 12/1979 | Barth | 252/99 |
| 4,253,842 | 3/1981 | Ehrlich | 252/92 |
| 4,256.699 | 3/1981 | Krisp et al. | 252/174 |
| 4,417,993 | 11/1983 | Gergely | 252/90 |
| 5,225,100 | 7/1993 | Fry et al. | 252/91 |

*Primary Examiner*—Paul Lieberman
*Assistant Examiner*—Michael P. Tierney
*Attorney, Agent, or Firm*—John S. Munday

[57] ABSTRACT

A cleaning composition and method for use with jewelry and the like, comprising a molded wafer of citric acid and sodium bicarbonate compressed together to produce effervescence for at least 15 minutes. The citric acid ranges from about 10% to about 30% and preferably about 18% to about 24% by weight of the weight of the formulation. The sodium bicarbonate ranges from about 35% to about 55% and preferably from 40% to about 44% by weight of the total weight. It includes a detergent selected from sodium lauryl sulfate, alkyl aryl sulfonate, tetra sodium ethylene diamine tetra acetic acid, and mixtures thereof which has been admixed into the compressed wafer in an amount sufficient to form a soap solution in up to two cups of water. Preferably, the surfactant comprises about 6% to 10% of sodium lauryl sulfate, about 12% to 18% of alkyl aryl sulfonate, and about 4% to 6% of tetra sodium ethylene diamine tetra acetic acid. Also included is a quantity of mold release to permit easy release of the wafer after compression. The mold release comprises about 3% to 7% of silica by weight of the total weight of the formulation. The wafer in packaged in an outer package sealingly protecting the wafer from air and moisture until the package is opened for use.

5 Claims, No Drawings

JEWELRY CLEANER FORMULATION

FIELD OF THE INVENTION

The present invention relates to a cleaning composition and method for use with jewelry and the like. More particularly, the present invention relates to a molded wafer having cleaning agents and effervescence producing agents having a unique method for producing effervescence for at least 15 minutes to produce unexpectedly clean jewelry and the like.

BACKGROUND OF THE INVENTION

For as far back as the history of humanity has been recorded, the use of jewelry and decorative objects has been an integral part of life. Gold, silver, platinum and other precious metals have been shaped into rings, broaches, pins, pendants, bracelets, anklets, wrist bands, and the like. To these decorative objects of art have been added diamonds, emeralds, rubies, sapphires and other precious and semi-precious stones. Other decorative jewelry has also been made from many other materials, as each piece of jewelry becomes an expression of art and of beauty as seen by the craftsman and the person selecting or wearing the jewelry.

While many beautiful pieces have been created over the centuries, and while the most exclusive and expensive examples of the jeweler's art are worn, if at all, only on 'special' occasions, some jewelry is worn on a regular basis. Wedding and engagement rings may never be removed during the lifetime of the wedded couple. Other 'favorite jewelry' such as mother's rings, school rings, identification bracelets and the like are also worn all the time. In either case, whether a piece of jewelry is seldom if ever worn or if it is never not in use, the jewelry can and does get dirty. Ordinary dirt, grease, makeup, oil, food, and all the other contaminants of life contact the jewelry and, in most cases, decrease the visual brilliance of the piece. Gold and diamonds possess eternal beauty, but that beauty is not as evident when the gold or diamond is covered with dirt.

Extremely rare or valuable jewelry is often cleaned only by professional jewelers and gem smiths who use optimum techniques to preserve and restore the essential beauty of the metal and stone. These procedures are expensive, time consuming and virtually inappropriate for the more frequently used jewelry, if only because of the inconvenience and cost which their use entails. Unfortunately, to the present time there has not been offered a satisfactory alternative to the professional cleaning that admittedly does a fine job but which is also impractical. For that reason, if really nice jewelry is worn a few times and becomes dirty, and if it is an occasional piece, such as a pendant worn in more formal occasions, it looses its beauty and in time and no longer gets worn, unless it is taken to a jeweler for cleaning. Too often that option is ignored or forgotten. One may only remember that the piece needs cleaning when one is about to wear it, which is not the time to go the jewelry store to have it cleaned.

If the jewelry is always in use, there is the reluctance to part with it even for cleaning. Unfortunately, as more dirt and grease slowly accumulated on it, the brilliance slowly decreases, so that its former beauty is not even remembered. Only when it is cleaned is the former condition recalled. It would be a great advantage to those who wear jewelry to have some way to clean that jewelry conveniently and quickly, at home or while traveling without involving a lot of difficulty.

There have been several proposed solutions for alternatives to having a jeweler clean jewelry and other valuable items. Silver polish is, of course, an alternative which can be used for some items. However, even that does not permit removal of dirt, tarnish and other contaminants from the crevices and corners of the silverware. Ultrasonic cleaners are also proposed and, in fact, are used by professional jewelers to clean rings and the like. However, vibration from ultrasonic waves does not remove dirt, grease, and the like. It is the action of soap or other cleaning solvents in the ultrasound bath which accomplishes the cleaning. Also, ultrasound devices are not normally considered desirable objects to place in the dressing area of a home, so that they are either stored and sometimes too much trouble to unpack or are in remote areas of the house where the impulse to select certain jewelry is lost before the ultrasound can be found and made operable.

It is a fact of the industry that people who clean jewelry often think of that task only when the jewelry is being selected. This impulse selection often brings frustration rather than the pleasure that the jewelry is intended to bring.

While no one has directly suggested a formulation for cleaning jewelry, some of the components of the present invention have been employed in other art. Gergely U.S. Pat. No. 4,417,993 describes a cleaning tablet for tooth prostheses in which a long lasting effervescence is produced using a multiple chemical component system. Dental fixtures and jeweled gold are not totally related although some of the same materials are employed in their manufacture.

This same inventor has had several patents which relate to the method of making tablets of this type. Gergely U.S. Pat. No. 3,773,922 describes another method of manufacturing effervescent tablets, this time for dispensing medicine. Both systems use sodium bicarbonate and an acid to generate effervescence, although neither patent suggests that difficult to clean jewelry could be cleaned by such a concept, since it is of course true that effervescence alone does not clean jewelry.

The idea of using effervescence generation from sodium bicarbonate and citric acid is not new. Greenblatt, U.S. Pat. No. 2,105,690 teaches that it is old to have an effervescent tablet using potassium bicarbonate and citric acid. Elias U.S. Pat. No. 2,854,377 introduces the use of surface active agents. Keast et al U.S. Pat. No. 3,367,876 discloses sodium tripolyphosphate in large concentrations to increase the rate of dissolution of the general cleaning formulations disclosed therein. Schmitt U.S. Pat. No. 3,639,568 discloses the use of sodium lauryl sulfate in tablets that effervesce. Hill U.S. Pat. No. 3,704,227 discloses various sulfonates and colloidal silica for related compounds. There is no suggestion in any of these patents that jewelry cleaners can be effective using these starting materials.

Barth U.S. Pat. No. 4,180,467 describes a composition for denture cleaning with sustained carbon dioxide effervescence and also requires the use of a solid material such as potassium persulfate. Barth discloses a powder that has extended effervescence which is generated by a two phase system where an acid anhydride is employed to extend the effervescence. Other patents which use effervescence in some manner are Krisp et al U.S. Pat. No. 4,217,234, using tetrafluoroethylene materials; Tarral et al U.S. Pat. No. 4,824,664 disclosing a reaction product of sodium bicarbonate and citric acid where the reaction is stopped at a partial completion by application of vacuum; Duvall U.S. Pat. No. 4,942,039 describing a low sodium antacid with aspirin or the like included; Young U.S. Pat. No. 5,055,305 also using a two component systems to provide effervescence under acidic and alkaline conditions to prolong the reaction; and finally, Gioffre et al U.S. Pat. No. 4,818,518 disclosing an alternative source of carbon dioxide.

There is no teaching in the prior art of the use of a compressed formulation having a delaying action for the effervescence due to the compression, to thereby allow the detergent to work and prevent the user from stopping the cleaning. This is not shown or suggested in the prior art.

Accordingly, it is an object of the present invention to provide a method for cleaning and restoring jewelry as broadly defined herein to a clean, visually appealing condition with as little effort on behalf of the owner as possible.

Another object of this invention is to provide a formulation which is usable at home or while traveling, and which does not require significant equipment to implement complete cleaning and restoring jewelry.

Yet another object of the present invention is to provide a formulation which guides the user to complete the cleaning process before removing the jewelry from the process.

Other objects will appear hereinafter.

SUMMARY OF THE INVENTION

It has now been discovered that the above and other objects of the present invention may be accomplished in the following manner. Specifically, the present invention provides a cleaning composition and method for its use with jewelry and the like using a molded wafer of citric acid and sodium bicarbonate compressed together to produce effervescence for at least 15 minutes.

The amount of citric acid in the wafer ranges from about 10% to about 30% and preferably about 18% to about 24% by weight of the weight of the formulation. The quantity of sodium bicarbonate ranges from about 35% to about 55% and preferably from 40% to about 44% by weight of the total weight. This combination of citric acid and sodium bicarbonate has been found to be admirably effective in producing effervescence for at least 15 minutes or longer.

The formulation of the present invention further includes a detergent selected from sodium lauryl sulfate, alkyl aryl sulfonate, tetra sodium ethylene diamine tetra acetic acid, and mixtures thereof which are admixed into the formulation prior to formation of the compressed wafer in an amount sufficient to form a soap solution in up to two cups of water. Preferably, the detergent or surfactant comprises about 6% to 10% of sodium lauryl sulfate, about 12% to 18% of alkyl aryl sulfonate, and about 4% to 6% of tetra sodium ethylene diamine tetra acetic acid. The function of the detergent is, of course, to cause dirt, grease, natural body oils, and other contaminants to be released from the gold, silver or other metal surfaces, as well as from the diamonds or other stones which make up part of the jewelry and which must sparkle and shine to give maximum enjoyment from the jewelry.

Also included is a quantity of mold release to permit easy release of the wafer after compression. The mold release should include about 3% to 7% of silica by weight of the total weight of the formulation. Because the compression of the wafer is an important part of the present invention, it is important to be able to easily and safely remove the wafer from the compression mold without allowing any damage to the wafer to take place. It is contemplated that rapid, automated manufacture of the wafer will require high speed molding and quick release from the mold is essential.

The action of water on the citric acid and sodium bicarbonate to cause effervescence upon solution and reaction of these components is, as has been described, designed to control the effervescence so that it lasts at least 15 minutes. This can only be insured when steps are taken to prevent moisture from entering into the wafer, thereby initiating some reaction, until the time and need arises for use of the invention wafer. For that reason, an additional part of the invention is the requirement that the wafer be packaged in an outer package sealingly protecting the wafer from air and moisture until the package is opened for use.

DETAILED DESCRIPTION OF THE PREFERRED EMBODIMENT

The present invention relates specifically to a jewelry cleaner composition or formulation which, in its simplest form, is a molded wafer of citric acid and sodium bicarbonate compressed together to give a compaction sufficient to produce effervescence for at least 15 minutes. Also present is a quantity of detergent admixed into said wafer prior to compression thereof in an amount sufficient to form a soap solution in up to two cups of water. Also forming part of the wafer is a quantity of surfactant admixed into said compressed wafer prior to compression or formation. The surfactant is present in an amount sufficient to substantially reduce the amount of foam formed by said effervescence and said soap solution.

In its most practical form, the invention also includes the use of a quantity of mold release admixed in said wafer to permit easy release of said wafer after compression. It is important to use an outer package sealingly protecting the wafer from air and moisture until the package is opened for use.

The quantity of citric acid is that which is necessary to cooperatively produce effervescence with the sodium bicarbonate and these two components are to be generally stoichiometrically balanced to generate a maximum amount of carbon dioxide. The citric acid optimally ranges from about 10% to about 30% by weight of the total weight of said composition. Preferred is a citric acid range of from about 18% to about 24% by weight of the total weight of the composition. Similarly, the sodium bicarbonate optimally ranges from about 35% to about 55% by weight of the total weight of said composition. Preferred is a sodium bicarbonate range of from about 40% to about 44% by weight of the total weight of said composition.

It is an important feature of the present invention that the quantity of these two components cooperatively act to produce the effervescence over this extended period of time because of two reasons. First, it should be understood that the effervescence itself does not actually clean dirt, grease, and other contaminants from jewelry except in the very slightest way. In actual experiments, it has been determined that jewelry having caked on, difficult to remove dirt and the like will be cleaned almost exactly as quickly and thoroughly when the warm water and detergents or soaps are contacted with the jewelry and accompanied with gentle stirring. Essentially, the majority of the cleaning comes from the contact of surface active agents in warm water on dirt held on the metal or stone of the jewelry, while the stirring or effervescence serves only to increase the contact of the cleaning agents on the contaminant.

Second, persons cleaning jewelry often think of cleaning the particular piece or pieces of jewelry of interest at the time when the jewelry is being selected. This time of selection is often the same time that the person will be wearing the jewelry, thus putting a time pressure on the cleaning process. Essentially, persons who have decided to wear and therefore clean a diamond broach, for example, are not likely to want to wait for a specified period of time just because the instructions indicate that this time is needed. These same persons are likely to wait until essentially all of the effervescence has dissipated. The present invention takes into account the time needed for cleaning and employs the effervescence as a signal to the user that the cleaning has been completed.

The key feature of the present invention for insuring that the effervescence will continue for at least 15 minutes is accomplished by the degree of compression of the wafer ingredients. The effervescence is caused by the chemical reaction between the citric acid and the sodium bicarbonate, as is well known per se, when water is added to the solid mixture of the two components. The addition of water such as by dropping a quantity of the components into water, for example, will initiate the generation of effervescence. If these effervescence generating components were in powder form, as might be suggested in the prior art, an uncontrolled production of carbon dioxide will take place at once and the effervescence will be done in just a few moments. The present invention improves on that known reaction by the compression of the components into a wafer of sufficient density that water cannot immediately penetrate the wafer and thus cannot dissolve the components. Only after a controlled period of time of at least 15 minutes will all of the citric acid and sodium bicarbonate be dissolved in the water and have an opportunity to react to produce effervescence.

The surfactant for the present invention is selected from the group consisting of sodium lauryl sulfate, alkyl aryl sulfonate, tetra sodium ethylene diamine tetra acetic acid, and mixtures thereof. A preferred surfactant is a combination of about 6% to 10% of sodium lauryl sulfate by weight of the total weight of said composition, about 12% to 18% of alkyl aryl sulfonate by weight of the total weight of said composition, and about 4% to 6% of tetra sodium ethylene diamine tetra acetic acid by weight of the total weight of said composition.

It is also important to include a quantity of mold release agent in the composition of this invention. Use of a mold release allows the compression or compaction of the wafer to be sufficiently dense so that water will not solubalize the citric acid and sodium bicarbonate immediately, but will act over a period of at least 15 to 20 minutes. The preferred mold release comprises about 3% to 7% of silica by weight of the total weight of the composition.

It should be appreciated that water and water vapor will have a negative effect on the components of the present invention until the time that the wafer is placed in warm water along with the jewelry intended to be cleaned. For that reason, protection of the wafer is necessary. This is achieved by keeping the wafer in an outer package sealingly protecting the wafer from air and moisture until the package is opened for use. Advertising and instructions can readily be printed on the outer package.

The present invention has been tested to determine the efficacy of the cleaning composition described herein. Use of the invention includes the step of adding the compressed wafer described above and jewelry which is to be cleaned to a quantity of up to two cups of hot tap water for sufficient time to permit at least 15 minutes of effervescence. During this time, the detergent is repeatedly brought into contact with the surface of the jewelry piece. The surfactant reduces foam and facilitates wetting of the ring or other object by the detergent. Use of warm water or hot tap water increases the activity of the detergent, just as it is known that warm water assists in most washing operations.

The effervescence does not directly remove much, if any, of the dirt, grease and the like, but does serve the two aforementioned functions. First, the detergent and surfactant are constantly stirred or moved over the surface of the jewelry being cleaned to increase contact between the cleaning agents and the dirt. Second, the agitation by effervescence tends to free already loosened dirt, allowing deeper cleaning by the detergent.

To demonstrate the efficacy of the present invention, various experiments described herein were performed. Various formulations were employed with the amount of citric acid and sodium bicarbonate being varied as described above. Different detergents and surfactants as described above were used in various formulations with equal results. Both liquid and powder detergents may be used with equal facility, since the bulk of the wafer is formed from the dry or powdered citric acid and sodium bicarbonate.

Various mold tests were made to determine the extend of compression necessary to delay access of water to the formulation and prolong effervescence. It was found that normal compression of the composition into a wafer which does not crumble or flake when packaged as described herein will be sufficiently compressed to delay access of water to at least a portion of the citric acid and sodium bicarbonate to reach the desired 15 to 20 minutes of effervescence.

Tablets or wafers of two gram, three gram and four gram sizes were prepared. All of the wafers were able to produce clean jewelry which had a film-free appearance. Obviously, a singe three gram wafer will not clean an entire collection of jewelry, but it will clean effectively the amount of jewelry which can reasonably be placed in a one or two cup container along with hot water. If for some reason a particularly large piece of jewelry such as tiara or the like were to be cleaned, more water and an additional wafer or wafers would be used.

A number of pieces of regularly worn jewelry were randomly selected from a group of persons. During the experiments, each piece was placed in a container holding from one to two cups of hot water. The wafer of this invention was added to the hot water and allowed to dissolve. As the wafer dissolved, the citric acid and sodium bicarbonate reacted to cause effervescence for 15 or 20 minutes or more. It was noted that hotter water caused more rapid effervescence and simultaneously there was more rapid cleaning at the hotter water temperature. In all cases, the wafers which had been compressed to a solid, non-flaking density were able to produce at least 15 minutes of effervescence.

Additional and similar pieces of jewelry were similarly selected at the same time as some of the above experiments. These additional pieces were subjected to ultrasound cleaning in a professional jewelry store, with commercial cleaning solutions. The wafer of the present invention was determined to produce equally satisfactory results without the use of expensive equipment and industrial strength solutions. For the first time, the non-professional is able to clean jewelry at the moment of impulse, or at leisure in the home, or when traveling.

While particular embodiments of the present invention have been illustrated and described, it is not intended to limit the invention, except as defined by the following claims.

I claim:

1. A jewelry cleaner composition, comprising:

a molded wafer of citric acid and sodium bicarbonate compressed together in an amount effective to give a compaction sufficient to produce effervescence for at least 15 minutes;

a quantity of detergent comprising about 6% to 10% of sodium lauryl sulfate by weight of the total weight of said composition, about 12% to 18% of alkyl aryl sulfonate by weight of the total weight of said composition, and about 4% to 6% of tetra sodium ethylene diamine tetra acetic acid by weight of the total weight of said composition, admixed into said compressed wafer prior to formation of said wafer in an amount sufficient to form a detergent solution in up to two cups of water;

a quantity of mold release admixed in said wafer in an amount effective to permit easy release of said wafer after compression; and an outer package sealingly protecting said wafer from air and moisture until said package is opened for use.

2. The composition of claim 1, wherein said citric acid ranges from about 10% to about 30% by weight of the total weight of said composition.

3. The composition of claim 2, wherein said citric acid ranges from about 18% to about 24% by weight of the total weight of said composition.

4. The composition of claim 1, wherein said sodium bicarbonate ranges from about 35% to about 55% by weight of the total weight of said composition.

5. The composition of claim 4, wherein said sodium bicarbonate ranges from about 40% to about 44% by weight of the total weight of said composition.

* * * * *